US010508514B1

(12) United States Patent
Daniel et al.

(10) Patent No.: US 10,508,514 B1
(45) Date of Patent: Dec. 17, 2019

(54) ARTIFICIAL LIFT METHOD AND APPARATUS FOR HORIZONTAL WELL

(71) Applicant: GEODYNAMICS, INC., Millsap, TX (US)

(72) Inventors: David Charles Daniel, Missouri City, TX (US); David S. Wesson, Ft. Worth, TX (US); John T. Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 16/106,099

(22) Filed: Aug. 21, 2018

Related U.S. Application Data

(60) Provisional application No. 62/682,466, filed on Jun. 8, 2018.

(51) Int. Cl.
*E21B 34/16* (2006.01)
*E21B 43/12* (2006.01)
*E21B 34/00* (2006.01)

(52) U.S. Cl.
CPC ..... *E21B 34/16* (2013.01); *E21B 43/123* (2013.01); *E21B 2034/002* (2013.01)

(58) Field of Classification Search
CPC ..... E21B 34/16; E21B 34/066; E21B 34/12; E21B 34/14; E21B 43/123; E21B 2034/002; F16K 11/0565; F16K 15/183; F16K 15/188; Y10T 137/0753; Y10T 137/0874
USPC ..... 137/38, 43, 519.5, 533.11, 329.3, 329.2, 137/601.21
See application file for complete search history.

(56) References Cited

U.S. PATENT DOCUMENTS

| | | | | |
|---|---|---|---|---|
| 2,675,815 | A * | 4/1954 | Dale | F16K 15/04 137/43 |
| 5,911,278 | A | 6/1999 | Reitz | |
| 6,328,052 | B1 * | 12/2001 | Loyning | F16K 5/0605 137/1 |
| 6,672,392 | B2 | 1/2004 | Reitz | |
| 7,080,690 | B2 | 7/2006 | Reitz | |
| 7,100,695 | B2 | 9/2006 | Reitz | |
| 7,191,838 | B2 | 3/2007 | Reitz | |
| 7,328,749 | B2 | 2/2008 | Reitz | |
| 7,832,468 | B2 | 11/2010 | Zupanick | |
| 7,971,649 | B2 | 7/2011 | Zupanick | |
| 8,167,052 | B2 | 5/2012 | Zupanick | |
| 8,276,673 | B2 | 10/2012 | Zupanick | |
| 2009/0032244 | A1 * | 2/2009 | Zupanick | E21B 33/128 166/105.5 |
| 2012/0043088 | A1 * | 2/2012 | McAllister | E21B 43/385 166/325 |
| 2015/0071794 | A1 | 3/2015 | Zupanick | |
| 2015/0129043 | A1 * | 5/2015 | Hughes | F16K 15/188 137/12 |

* cited by examiner

*Primary Examiner* — David Carroll
(74) *Attorney, Agent, or Firm* — Patent Portfolio Builders PLLC

(57) ABSTRACT

An artificial lifting system for bringing a formation fluid from a horizontal well to the surface, the system including an outer production tubing that extends into the well, from a head of the well to a lateral portion of the well; and a hybrid valve attached to a distal end of the outer production tubing. The hybrid valve has two orientations, a first orientation for which the hybrid valve acts as a one-way valve, and a second orientation for which the hybrid valve acts as a conduit.

13 Claims, 19 Drawing Sheets

ARTIFICIAL LIFT METHOD AND APPARATUS FOR HORIZONTAL WELL

BACKGROUND

Technical Field

Embodiments of the subject matter disclosed herein generally relate to downhole tools for oil/gas exploitation, and more specifically, to an artificial lift method and associated system for maximizing pressure drawdown across a lateral of a horizontal well.

Discussion of the Background

After a well is drilled to a desired depth (H) relative to the surface, and a casing protecting the wellbore has been installed, cemented in place, and perforated for connecting the wellbore to the subterranean formation, it is time to extract the oil and/or gas. At the beginning of the well's life, the pressure of the oil and/or gas from the subterranean formation is high enough so that the oil flows out of the well to the surface, unassisted. However, the fluid pressure of the formation decreases over time to such a level that the hydrostatic pressure of the column of fluid in the well becomes equal to the formation pressure inside the subterranean formation. In this case, an artificial lift method (i.e., pump method) needs to be used to recover the oil and/or gas from the well. Thus, artificial lift is necessary for the well to maximize recovery of oil/gas.

There are many ways to assist the fluid (oil and/or gas) inside the well for being brought to the surface. One such method is the gas lift, which is typically characterized by having a production tubing, which is installed inside the production casing, stung into a downhole packer. The gas lift method is able to work in both low and high fluid rate applications and works across a wide range of well depths. The external energy introduced to the system for lifting the oil and/or gas is typically added by a gas compressor driven by a natural gas fueled engine. There can be single or multiple injection ports used along the vertical profile of the tubing string for the high pressure gas lift gas to enter the production tubing. Multiple injection ports reduce the gas lift gas pressure required to start production from an idle well, but it introduces multiple potential leak points that impact reliability. Single injection ports (including lifting around open-ended production tubing) are simpler and more reliable, but require higher lift gas pressures to start production from an idle well.

The gas lift method works by having the injected lift gas mixing with the reservoir fluids inside the production tubing and reducing the effective density of the fluid column. Gas expansion of the lift gas also plays an important role in keeping flow rates above the critical flow velocities to push the fluids to the surface. For this method, the reservoir must have sufficient remaining energy to flow oil and gas into the inside of the production tubing and overcome the gas lift pressures being created inside the production tubing. The ultimate abandonment pressure associated with conventional gas lift methods and apparatus is materially higher than other methods such as rod or beam pumping.

Another method for pumping the fluid from inside the well to the surface is the Rod or Beam pumping, which typically produces the lowest abandonment pressure of any artificial lift method and ends up being the "end of life" choice to produce an oil well through to its economic limit. Rod pumping is characterized by the installation of production tubing, sucker rods and a downhole pump. Rod or Beam Pumping works in low to medium rate applications and from shallow to intermediate well depths. The downhole pump is typically installed in the well at a depth where the inclination from vertical is no greater than typically 15 degrees per 100' of vertical change, thus, limiting the pump intake to being no deeper than the curve in the heel to the horizontal well. The Rod or Beam Pumping in a deviated section typically has high rates of mechanical failures that creates higher operating expenses and more production downtime. The external energy introduced to the system is typically added through the use of a prime mover driving a gearbox on the "pumping unit." The prime mover can be an electrically driven motor or a natural gas fueled engine.

Another lifting process uses an Electrical Submersible Pump (ESP) to pump the fluid from the well. This process is characterized by the installation of centrifugal downhole pumps and downhole motors that are electrically connected back to the surface with shielded power cables to deliver the high voltage/amps necessary to operate. ESPs work in medium to high rate applications and from shallow depths to deep well depths. ESPs can be very efficient in a high rate application, but are expensive to operate and extremely expensive to recover and repair when they fail. Failure rates are typically higher for ESPs relative to other artificial lift methods. ESPs do not tolerate solids well so being used in a horizontal well that has been fracture stimulated with sand proppant introduces a likely failure mechanism. ESPs are also not very tolerant of pumping reservoir fluids with a high gas fraction. ESPs are typically only run into the curve/heel of a horizontal lateral.

Another lifting process uses Hydraulic Jet Pumps (HJPs), which are characterized by the installation of a production tubing, a downhole packer, a jet pump landing sub, and jet pump. Surface facilities associated with a HJP application require a separator and a high pressure multiplex pump. The system creates a pressure drop at the intake of the jet pump (Venturi effect) by circulating high pressure power fluids (oil or water) down the inside of the production tubing. Wellbore fluids and power fluids are then recovered at the surface by flowing up the annulus between the production casing and production tubing. The external energy introduced to the system is typically added through an electrical connection providing high voltage/amps. Some systems can use a natural gas driven prime mover connected to the multiplex pump. HJP's can be used across a wide range of flow rates and across a wide range of well depths, but are not able to be deployed typically past the top part of the curve in a horizontal well. HJP's also generally result in a relatively high abandonment pressure if that is the "end of life" artificial lift method when a well is abandoned.

Still another lifting method is a Plunger Lift, which is characterized by the installation of a production tubing run with a downhole profile and spring installed on the bottom joint of tubing. A "floating" plunger that travels up and down the production tubing acting as a free moving piston removes reservoir fluids from the wellbore. There is typically no external energy required, however, there are variations in this technology where plungers can operate in combination with a gas lift system. Plungers are an artificial lift method that generally only applies to low rate applications. They can be used, however, across a wide range of well depths, but are limited to having the bottom spring installed somewhere in the curve of a horizontal well. Use of a plunger lift also generally results in a relatively high abandonment pressure if that is the "end of life" artificial lift method when a well is abandoned. Plunger applications in horizontals appear to be mostly used in the "gas basins."

Another lifting method is the Progressive Cavity Pumping (PCP), which is characterized by the use of a positive displacement helical gear pump operated by the rotation of a sucker rod string with a drive motor located on the surface on the wellhead. PCP's are powered by electricity. They are tolerant of high solids and high gas fractions. They are, however, applicable mostly for lower rate wells and have higher failure rates (compared to gas lift) when operated in deviated or horizontal wells.

An artificial lift method that was only applied in the field as a solution to unload gas wells that were offline as a result of having standing fluid levels above the perforations in a vertical well is the Calliope system, which is schematically illustrated in FIG. 1 (which corresponds to FIG. 5 of U.S. Pat. No. 5,911,278). The Calliope system 100 utilizes a dedicated gas compressor 102 for each well to lower the producing pressures (compressor suction) a well 104 must overcome while using the high pressure discharge from the compression (compressor discharge) as a source of gas lift. The Calliope system was successful at taking previously dead gas wells and returning them to economic production levels and improving gas recoveries from the reservoir. Each wellsite installation has a programmable controller (not shown) that operates a manifolded system (which includes plural valves 110A to 110J) to automate the connection of the compressor suction to the casing 120, production tubing 130, and/or an inner tubing 140, or conversely, to connect the compressor discharge to these elements. Various pressure gauges 112A to 112D are used to determine when to open or close the various valves 110A to 110J. The production tubing 130 has a one way valve 132 that allows a fluid from the casing 120 to enter the lower part of the production tubing 130 and the inner tubing 140, but not the other way. The fluid flows from the formation 114 into the casing 120, through holes 116 made during the perforating operation, and into the casing production 125 tubing annulus. By connecting the discharge and suction parts of the compressor 102 to the three elements noted above, the fluid from the bottom of the well 104 is pumped up the well, to a production pipe 106. Although this method works in an efficient way in a vertical well, as illustrated in FIG. 1, the same configuration will fail in a horizontal well because valve 132 is designed in a way that only works when in a vertical well.

Regarding the other discussed methods, they are impractical to be used in the horizontal section of the well for a variety of reasons. For example, they can only provide lift from varying positions in the heel of the well. In vertical wells, there is typically a "sump" below the perforations, which is the ideal location for the pumps used in the lift methods to be located, while, in a horizontal well, no such sump exists past the heel, and the pump or lift mechanism is forced to be located directly in the production stream. These lift mechanisms cannot be located adjacent or below the lowest perforations in a horizontal well, as is preferred and possible in a vertical well. This means that practically, additional lift is required, wear is increased, reliability is reduced, additional failure mechanisms are introduced, and the abandonment pressure at which the lift is no longer practical is increased, thus unnecessarily leaving behind recoverable oil in the reservoir.

As can be seen from this brief summary of the existing lift methods, they are not appropriate for fluid lift in a horizontal well. Thus, there is a need to provide an apparatus and method that overcome the above noted problems and offer the operator of a well the possibility to further exploit/produce a well when the well is close to its end life.

SUMMARY

According to an embodiment, there is an artificial lifting system for bringing a formation fluid from a horizontal well to the surface, the system including an outer production tubing that extends into the well, from a head of the well to a lateral portion of the well, and a hybrid valve attached to a distal end of the outer production tubing. The hybrid valve has two orientations, a first orientation for which the hybrid valve acts as a one-way valve, and a second orientation for which the hybrid valve acts as a conduit.

According to another embodiment, there is a hybrid valve to be attached to an outer production tubing of an artificial lifting system for bringing a formation fluid from a horizontal well to the surface, the hybrid valve including a body, a first chamber formed in the body, a ball located inside the first chamber, an intake channel fluidly connected to the first chamber, and an intake port connected to the intake channel and facing an exterior of the body. The ball blocks the intake channel when the body is oriented according to a first orientation so that the hybrid valve acts as a one-way valve, and the ball is not interfering with the intake channel when the body is oriented according to a second orientation so that the hybrid valve acts as a conduit.

According to still another embodiment, there is a method for artificial lifting a formation fluid from a horizontal well to the surface, the method including a step of lowering into the well an outer production tubing and a hybrid valve, wherein the hybrid valve is attached to the outer production tubing and sits in a horizontal part of the well; a step of checking whether the hybrid valve has a first or second orientation; a step of orienting the hybrid valve to have the first orientation; a step of pumping gas under pressure in a casing of the well to transfer a formation fluid from the casing into the outer production tubing through the hybrid valve; and a case of lifting the formation fluid through the outer production tubing to the surface.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a three chamber tool used for lifting a fluid from a horizontal well. However, the embodiments discussed herein are also applicable to a vertical well or to a two-chamber tool.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
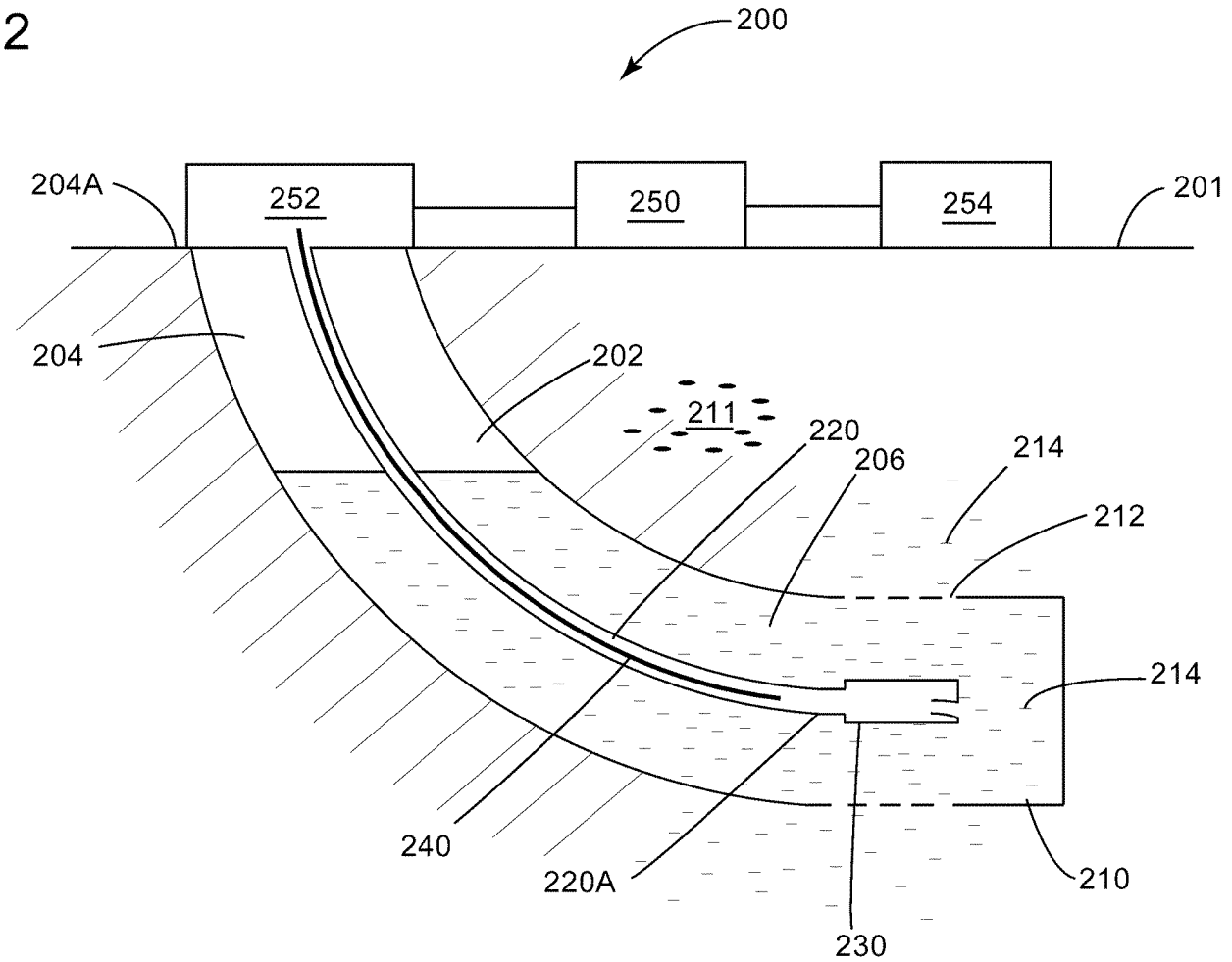
FIG. 2 illustrates a horizontal well and a hybrid valve that allows artificial pumping of the oil from the lateral part of the well.

According to an embodiment illustrated in FIG. 2, there is an artificial lift system 200 that is capable of lifting a fluid from a horizontal section of a multistage, fracture stimulated well 202. The well 202 has a vertical part 204 and a horizontal part 206. A casing 210 is placed in the well 202 for preventing the formation 211 to block the well. The casing 210 has plural holes 212 formed during a perforating operation. The plural holes may be formed in stages, i.e., at various locations along the horizontal part 206. A fluid 214 (which may include oil, gas, water, etc.) from the formation 211 enters through the holes 212 into the well 202 and accumulates in the horizontal part 206 (also called lateral part of the well).

The lift system 200 includes an outer production tubing 220 that extends from the head 204A of the well to the horizontal part 206. The outer production tubing 220 is closed by a hybrid valve 230 at its distal end 220A, i.e., the end farthest from the head of the well. The hybrid valve 230, as discussed later, is a one way valve when having a first orientation, and a conduit when having a second orientation. The lift system 200 may also include an extraction support mechanism 240 (e.g., an inner production tubing, a pump, tubing with turbolizers, etc.), which is also discussed later in more detail. The extraction support mechanism 240 works in tandem with the outer production tubing 220 and the hybrid valve 230 to lift the fluid 214 to the surface 201. The lift mechanism 200 may also include a compressor 250, that is attached to a manifold 252 and controlled by a controller 254. Manifold 252, which is discussed later, is configured to supply various pressures to the casing 210, outer production tubing 220, and the extraction support mechanism 240.

Figure 3A:
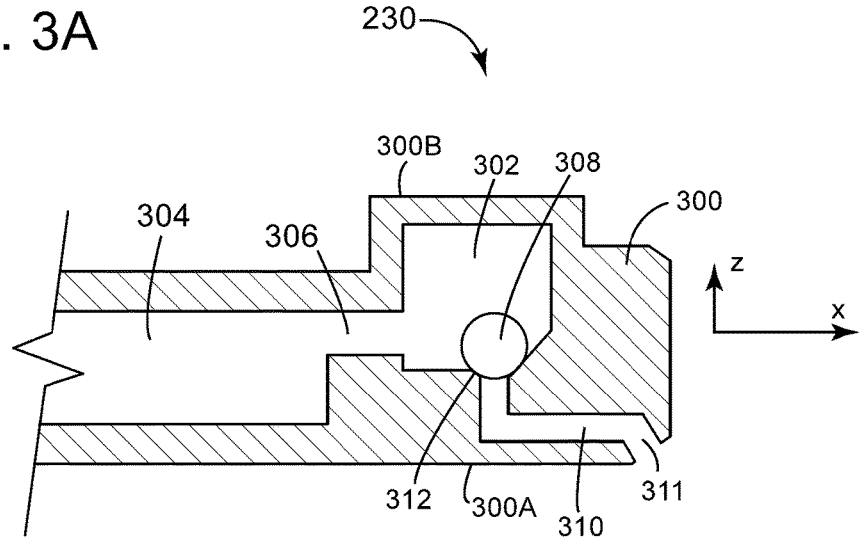
FIGS. 3A and 3B illustrate a cross-section of the hybrid valve having two different orientations.
Figure 3B:
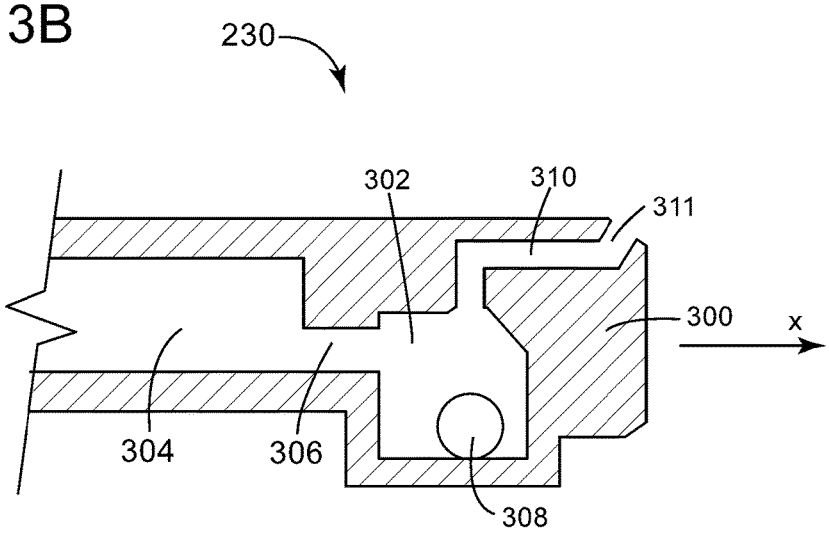

Details of the hybrid valve 230 are now discussed with regard to FIGS. 3A and 3B. Hybrid valve 230 has a body 300 that includes a first chamber 302 and a second chamber 304. An internal passage 306 separates the first chamber from the second chamber. A ball 308 is placed inside the first chamber 302 and has a diameter larger than a diameter of the internal passage 306, so that the ball cannot escape from the first chamber through the internal passage 306. The body 300 has also an intake passage 310 that ensures a fluid communication between the first chamber 302 and an exterior of the hybrid valve, through an intake port 311. A diameter of the intake passage 310 is smaller than a diameter of the ball 308 so that the ball 308 cannot escape from the first chamber. The intake passage 310 ends with the intake port 311, which constitutes the interface between the body 300 and the exterior of the hybrid valve. Intake port 311 may be configured to be as close as possible to the bottom side 300A of the body 300. The bottom side 300A of the body 300 is defined as the lowest part of the hybrid valve 230, along the gravity direction Z. The body 300 also has a top side 300B, which is opposite to the bottom side 300A.

A seatball 312 may be formed in the body 300 so that the ball 308 mates with the seatball and seals the first chamber 302, from the exterior of the hybrid valve. This happens when a pressure inside the second chamber 304 is increased (as discussed later) beyond the pressure outside the hybrid valve so that a pressurized gas present in the second chamber cannot escape outside the hybrid valve. However, if the hybrid valve 230 is turned upside down, as illustrated in FIG. 3B, the ball 308 is not in contact with the seatball 312, and thus, it cannot block the intake passage 310. In this case, the internal passage 306, the first chamber 302 and the intake passage 310 form an uninterrupted channel between the second chamber 304 and the exterior of the hybrid valve, and thus, the hybrid valve acts now as a conduit.

Thus, the hybrid valve shown in FIGS. 3A and 3B acts as a valve for a first orientation (intake port having its lowest location) and acts as a conduit for a second orientation (intake port having its highest location), which is different from the first orientation. In other words, by rotating the hybrid valve 230 about its longitudinal axis X, the hybrid valve changes from a one-way valve to a conduit or from the conduit to the one-way valve. For this reason, the valve 230 is called herein a hybrid valve (it is part time valve and part time conduit). Note that the first orientation and the second orientation can span different angles. For example, with regard to the orientation of the intake port, which in this analogy corresponds to the tip of a tongue of a clock, the first orientation corresponds when the tongue of the clock is between 4 and 8, and the second orientation corresponds when the tongue is between 9 and 3. One skilled in the art would understand that other values can be selected to characterize the two orientations.

Figure 4A:
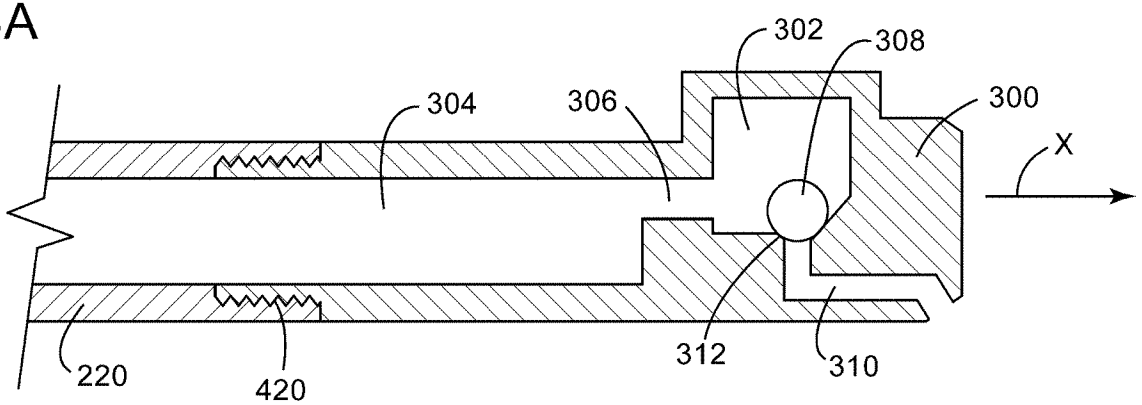
FIGS. 4A to 4C show various ways of attaching the hybrid valve to a production tubing.
Figure 4B:
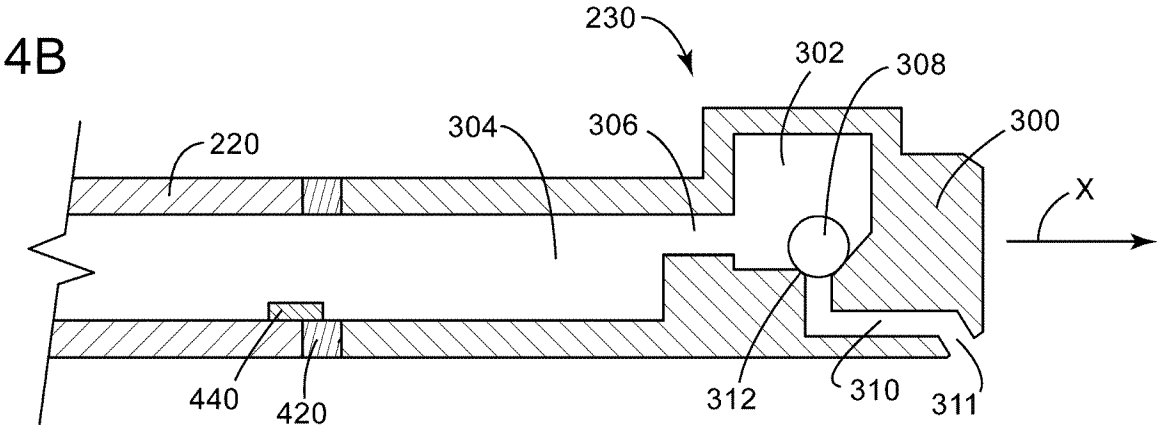

To rotate the hybrid valve along its longitudinal axis X, there are various mechanisms that can be implemented. According to one embodiment, the hybrid valve 230 is fixedly attached to the outer production tubing 220 (e.g., the hybrid valve is welded or screwed to the outer production tubing) and a rotation of the outer production tubing achieves a rotation of the hybrid valve. In this respect, FIG. 4A shows one end of the hybrid valve 230 being attached by threads 420 to the outer production tubing 220. FIG. 4B shows another possibility of attaching the hybrid valve to the outer production tubing 220, where a rotatable connection 430 attaches the hybrid valve to the outer production tubing. An engine 440 (for example, an electrical engine) may be placed inside the bore of the outer production tubing or the hybrid valve, in a wall of these elements or even outside of these elements. The engine 440 is connected to the rotatable connection 430 and may be controlled from the controller 254 (shown in FIG. 2) to rotate the hybrid valve 230 to make it act as a valve or as a conduit. Those skilled in the art would understand that other mechanisms for rotating the hybrid valve relative to the outer production tubing may be used.

Figure 4C:
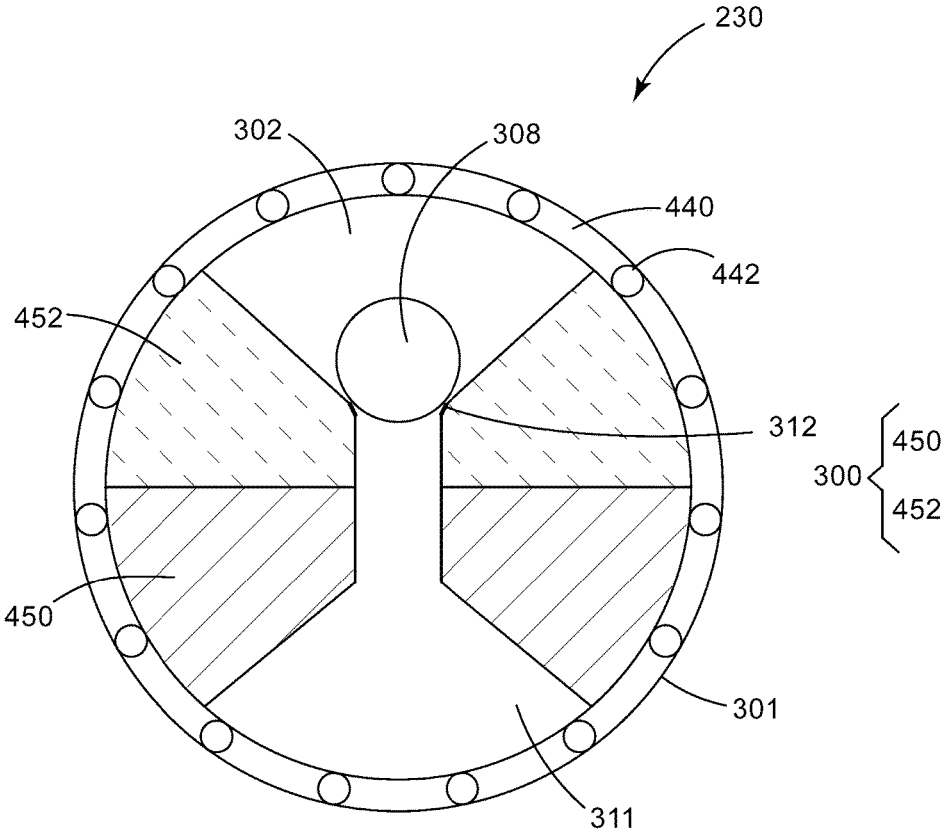

FIG. 4C shows still another variation of the hybrid valve, which does not need any external assistance for orienting the intake port 311 relative to the casing. In this embodiment, the body 300 of the hybrid valve is placed inside of a sleeve 301 and a connection mechanism 440 is located between the body 300 and the sleeve 301. The connection mechanism 440, in one embodiment, includes ball bearings 442, which allow the body 300 to freely rotate relative to the sleeve 301. In order to take advantage of the gravity, a first part 450 of the body 300 is made of a first material and a second part 452 of the body 300 is made of a second material, which is lighter than the first material. By distributing the first and second materials as shown in FIG. 4C, the lower part of the body 300, which holds the intake port 311 would be always heavier than the other part of the body. In this way, the first part 450 will always be below the second part 452, relative to the gravity, which achieves an orienting of the hybrid valve and implicitly the intake port 311 without any assistance from the operator or a motor. Other mechanisms than the ball bearings 442 may be envisioned for the connection mechanism 440, for example, using a spring or a flapper.

Figure 5A:
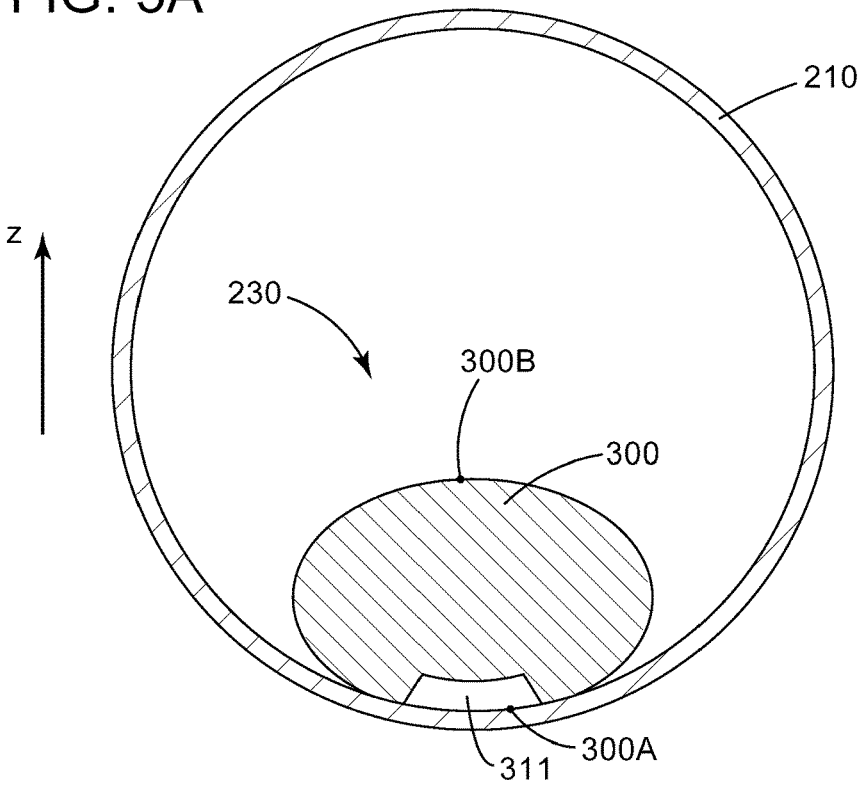
FIGS. 5A and 5B illustrate how an orientation of the hybrid valve is capable of extracting the oil at the bottom of the casing in a horizontal well.

To illustrate an advantage of the hybrid valve over a traditional one-way valve, a cross-section of the hybrid valve 230 and the casing 210 is shown in FIG. 5A. It is noted that in this embodiment, a cross-section of the hybrid valve 230 is round, i.e., circle or oval or ellipse, and the intake port 311 is shown being at its lowest position, so that the hybrid valve acts as a one-way valve. The exterior shape of the intake port 311 is curved to mate as closely as possible with the interior wall of the casing 210. The location of the intake port 311 is desired to be the lowest for the following reasons.

Figure 1:
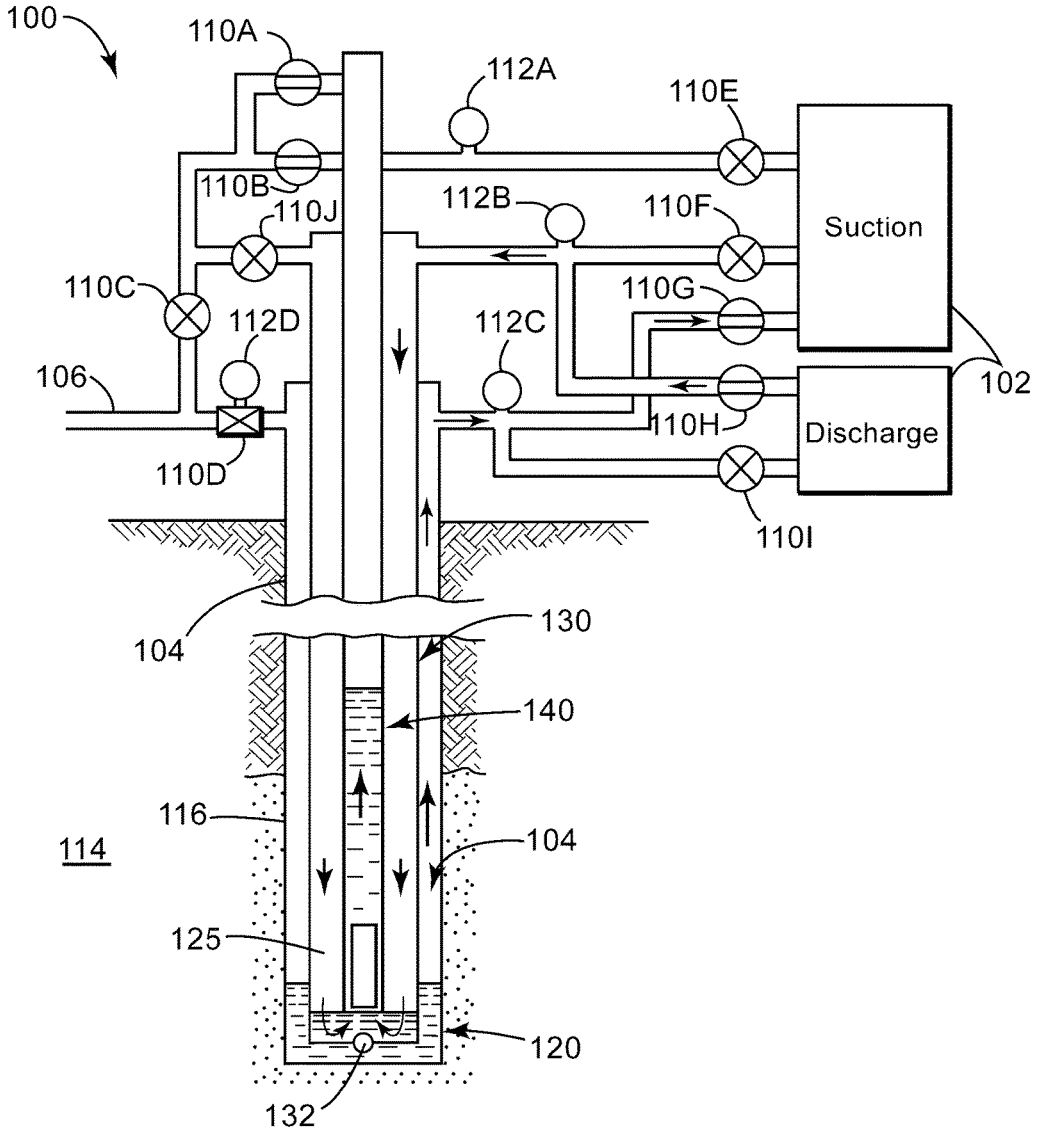
FIG. 1 illustrates a vertical well and associated equipment for well production operations.
Figure 5B:
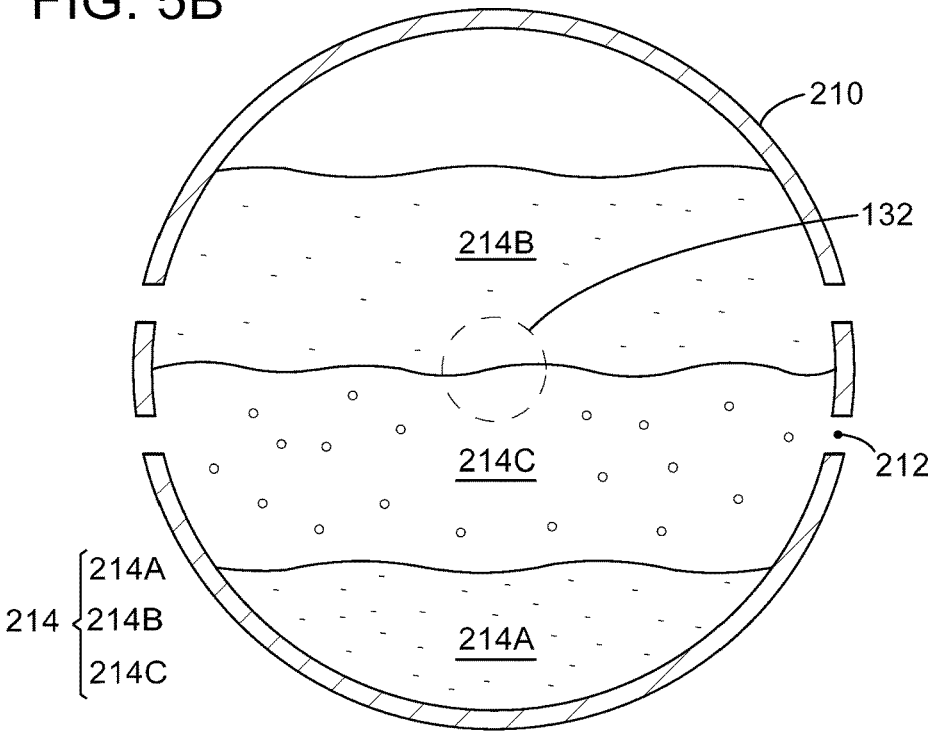

The formation fluid 214 pools inside the lateral part 206 of the well 202. FIG. 5B shows again a cross-section of the casing 210, in the lateral part of the well, but this time holes 212 are also present (valve 230 is omitted for simplicity). The formation fluid 214 may include water mixed with oil 214A, gas 214B, and other substances 214C. Because of their different densities, these components of the formation fluid 214 separate from each other as shown in FIG. 5B. In other words, a stratification of the formation fluid 214 is present in a horizontal well. One skilled in the art would understand that the water, gas, oil and other components are in practice not as clearly separated as shown in FIG. 5B. If the valve of a traditional lifting system, for example, valve 132 of the Calliope system 100 shown in FIG. 1, is placed in this horizontal well, that valve would be located approximately in the middle of the cross-section of the casing 210, as illustrated in FIG. 5B. However, this location of the valve 132 would be detrimental to the gas lifting system because the valve 132 would likely pull in more gas then oil/water. Even if the valve 132 would be closer to the lowest part of the casing 210, it is still likely that the valve would not be fully placed in the oil/water solution. As the lifting system is designed to lift oil/water, and not gas, the traditional valve 132 would render the system to be very inefficient.

However, the hybrid valve 230, with its intake port 311 configured to be placed as close as possible to the bottom part of the casing 210, as illustrated in FIG. 5A, solves the above problem as the intake port would be located in the water/oil region 214A of the fluid 214. Further, the hybrid valve 230 is designed to work only if the intake port is correctly positioned, i.e., closest to the bottom part of the horizontal casing. In this respect, note that as illustrated in FIG. 3B, if the orientation of the hybrid valve is not correct, the hybrid valve does not work as a valve, but as a conduit. The operator of the hybrid valve would be able to check the orientation of the valve by pumping a gas into the outer production tubing and checking whether its inside pressure is increasing. If the pressure is increasing, it means that the ball 308 is in position as illustrated in FIG. 3A, and the hybrid valve is oriented to act as a valve. If the pressure in the outer production tubing does not increase over a given threshold, it means that the hybrid valve acts as a conduit and the pumped gas is escaping into the casing and back to the surface. Thus, by pumping gas and monitoring the pressure inside the outer production tubing, the operator of the well determines the orientation of the hybrid valve and adjusts it as desired.

Figure 6:
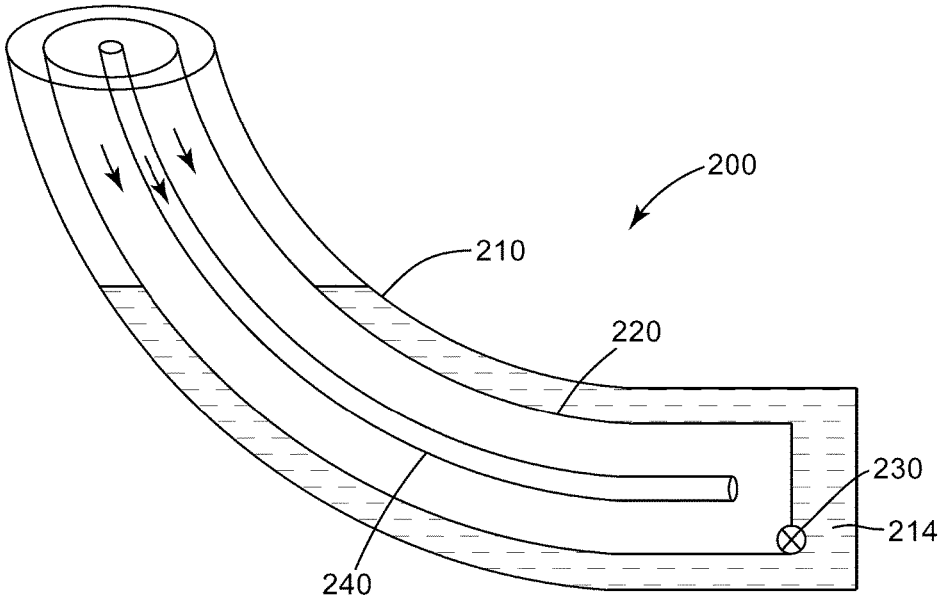
FIGS. 6 to 9 illustrate the various stages of artificially lifting the oil from a horizontal well by using a hybrid valve.

The hybrid valve 230 and the outer production tubing 220 may be used together with the extraction support mechanism 240 for extracting the oil that accumulates in the lateral part of the casing, as now discussed. In this embodiment, the extraction support mechanism 240 is a tube (called herein inner production tubing) having an external diameter smaller than an internal diameter of the outer production tubing 220, so that the inner production tubing fits inside the outer production tubing 220, as illustrated in FIG. 6. FIG. 6 schematically shows, for simplicity, only the three tubes and the hybrid valve 230. The heads of the three tubes (i.e., the portion that is connected to the compressor) are shown, again for simplicity, without any connection to the compressor. The connections between these three tubes and the compressor are shown and discussed later. The formation fluid 214 has accumulated inside the casing 210 as shown in the figure, and because its pressure is not enough to get the fluid to the surface through the casing, there is a need to lift the fluid to the surface.

After the outer production tubing 220 is connected to the hybrid valve 230, the two are lowered into the casing 210. Then, the inner production tubing 240 is lowered inside the outer production tubing 220 as shown in FIG. 6. At this point, the hybrid valve needs to be oriented so that the intake port is placed at its lowest location inside the casing. The operator of the well will supervise a controller that opens the valve between the compressor discharge port and the head of the outer production tubing and/or the inner production tubing and increases the pressure of the pumped gas (which is illustrated by arrows). If the pressure (measured with a pressure gauge as will be discussed later) increases over a certain threshold, the hybrid valve is correctly oriented and acts as a valve. However, if the pressure does not increase over the certain threshold, it means that the hybrid valve acts as conduit. In this case, the hybrid valve is reoriented. For example, if the hybrid valve is fixedly attached to the outer production tubing, the outer production tubing may be rotated, from the surface, until the hybrid valve is correctly oriented. This is the first stage of the artificial lifting, which is called the orientation stage.

Figure 7:
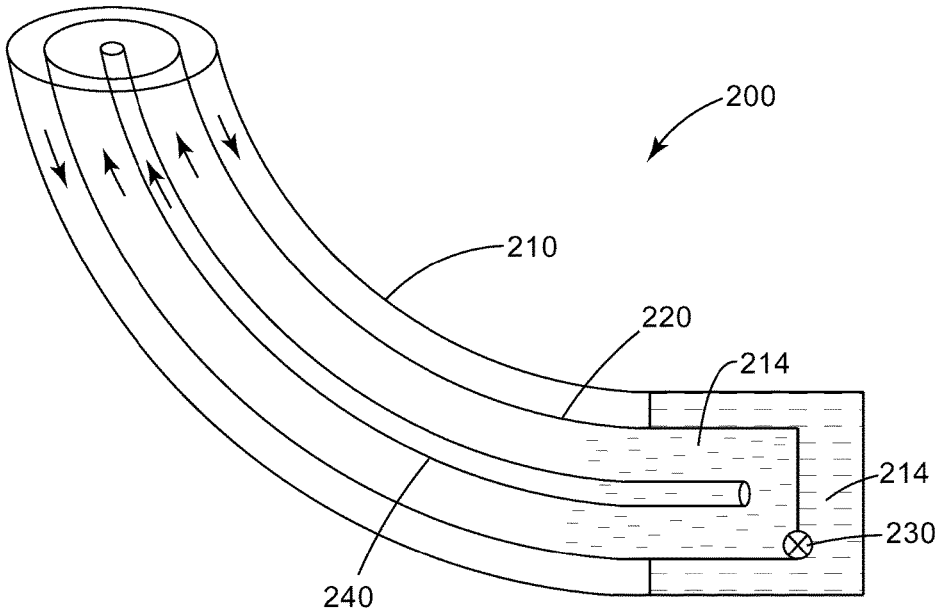

Next, during a second stage (also called formation fluid transfer), as illustrated in FIG. 7, a compressed gas (preferably natural gas) is pumped into the casing, as illustrated by the arrows inside the casing 210, so that the formation fluid 214 enters via the hybrid valve 230, into the outer production tubing 220 and inner production tubing 240. Note that FIG. 7 shows most of the formation fluid 214 has now moved from the casing 210 into the outer production tubing 220 and the inner production tubing 240. The formation fluid cannot go back into the casing because the hybrid valve 230 acts now as a one way valve. Optionally, a suction port of the compressor may be connected during the second stage to the outer production tubing and/or the inner production tubing for enhancing the transfer process of the formation fluid from the casing.

Figure 8:
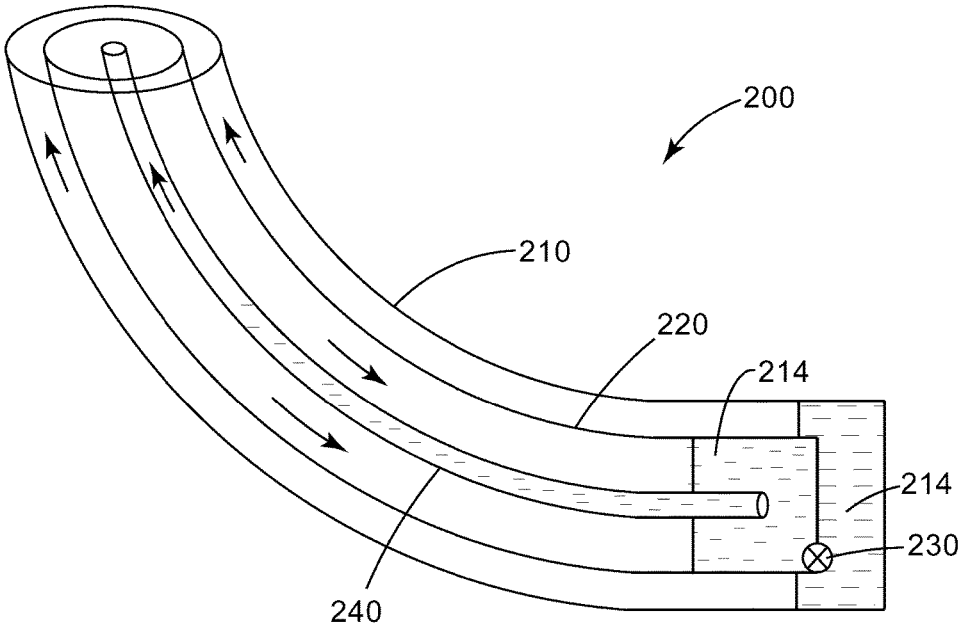

During a third stage (also called formation fluid lifting), which is illustrated in FIG. 8, the compressed gas from the compressor discharged is switched from the casing 210 to the outer production tubing 220 (as illustrated by the arrows). Optionally, the suction port of the compressor is connected to the casing 210 and/or the inner production tubing 240. The connection of the suction port to the casing 210 enhances the transfer of oil from the formation into the casing and the connection of the suction port to the inner production tubing 240 enhances the lifting of the oil through the inner production tubing 240. The compressed gas is pumped into the outer production tubing 220 (illustrated by arrows) and pushes the formation fluid from the bottom of the outer production tubing 220, which is now closed by the hybrid valve, into the inner production tubing 240 and at the surface.

Figure 9:
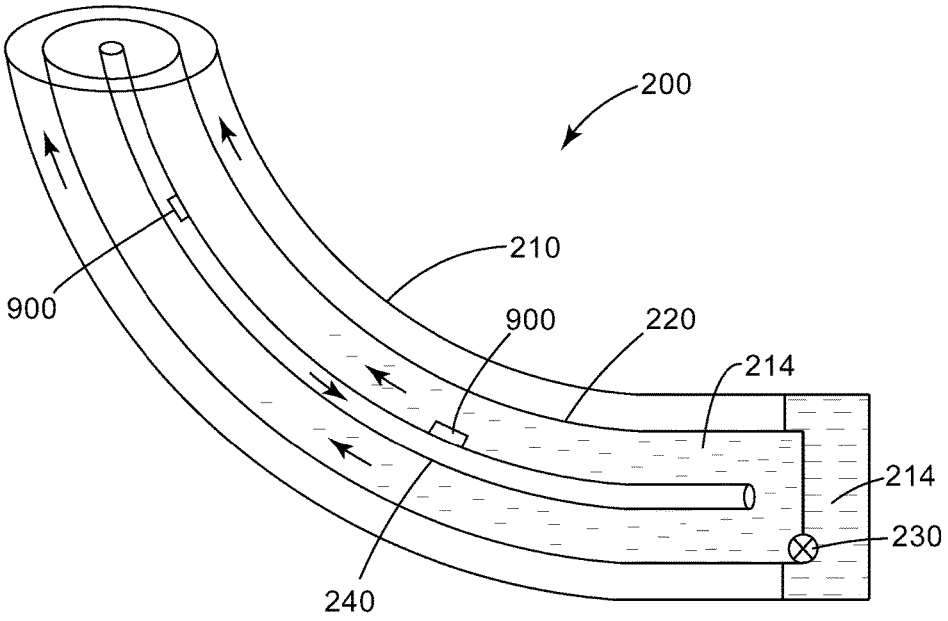

Alternatively, as shown in FIG. 9, the inner production casing 240 is connected to the discharge port of the compressor to push the formation fluid from the bottom of the well, through the outer production tubing 220, to the surface, as illustrated by the arrows. Optionally, the suction port of the compressor can be connected to the casing to promote fluid transfer from the formation to the casing 210 and/or to be connected to the outer production tubing 220 to enhance the artificial lift of the oil to the surface.

The operations shown in FIGS. 8 and 9 continue until the oil accumulated inside the outer production tubing 220 is lifted to the surface, at which time, the controller adjusts the compressor valves to return to the configuration illustrated in FIG. 7, i.e., filing the inside of the outer production tubing with formation fluid accumulated in the casing. In this way, even if the pressure in the formation fluid in a horizontal well is not high enough to take the oil to the surface, by alternating the gas pressure applied to the casing, outer production tubing and the inner production tubing, and by using the hybrid valve 230, is still possible to exploit the horizontal well.

For the embodiments discussed above, it is possible to place the end of the outer production tubing (and thus the low pressure sink) near the toe of the horizontal well, such that all clusters along the lateral length of the casing see a dynamic flowing condition and improving the ability for all clusters to contribute to production.

The horizontal wells create additional challenges that must be dealt with and were not encountered in the vertical (or near-vertical) configurations. Horizontal laterals create issues with stratified flow, liquid hold-up (in low points along the lateral), gas pockets (in high points along the lateral), etc. In one embodiment, the artificial lift system 200 may use a flow conditioner (e.g., turbolizers) to assist in creating a uniform flow regime (turbulent flow) such that solids could be more effectively removed from the well. For example, such a flow conditioner 900 may be placed on the outer production tubing 220 or the extraction support mechanism 240, as illustrated in FIG. 9. The flow conditioners 900 may additionally provide a centralization function of the inner production tubing 240 within the outer production tubing 220.

In one application, the inside diameter of the outer production tubing 220 and/or the extraction support mechanism 240 may be coated to minimize frictional issues during flow conditions as well as during the initial deployment or subsequent recovery of a given string.

In still another application, chemical treatments can be applied throughout the entire wellbore on all exposed surfaces for the casing, outer production tubing, and the extraction support mechanism, by either batch or continuous treating methods for corrosion, scale or paraffin/asphaltene inhibition. As an example, a batch treatment could be pumped down the casing and recovered through the outer production tubing and the extraction support mechanism. Continuous treatments could be pumped with the gas lift down the outer production tubing and recovered up through the extraction support mechanism. Other combinations are possible as well. The treatment system can be incorporated into the surface components of the system 200. Circulation is possible between any of the annulus volumes in order to clean or stimulate the well, with or without chemicals.

Figure 10:
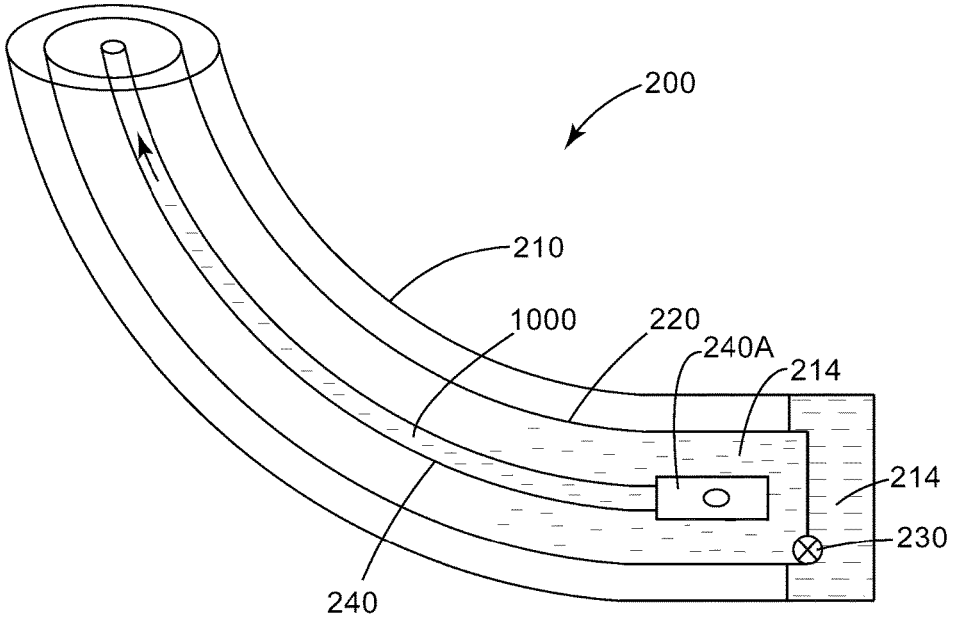
FIG. 10 illustrates a system that uses a submersible pump for lifting the oil from the horizontal well.

In still another embodiment, as illustrated in FIG. 10, the extraction support mechanism 240 can be implemented not as an inner production tubing as illustrated in FIGS. 6 to 9, but rather as a pump 240A. The pump may be a submersible pump or any other pump. In this case, after the formation fluid 214 was transferred through the hybrid valve 230 from the casing 210 into the outer production tubing 220, the pump 240A pumps the formation fluid up a bore 1000 of the extraction support mechanism 240 to the surface.

The new artificial lift system 200 can be used for stand-alone wells, but may also be used for multi-well pads, that utilize a single, larger compressor, and system to operate multiple wells, thereby realizing economies of scale not previously seen and also being able to utilize existing common facilities on the multi-well pad (e.g., tanks, booster compression, vapor recovery units, etc.). Through the use of programmable controllers, the flow of gas from the compressor to the various tubings/casing can be optimized to provide gas lift to the highest, best use among the wells on the multi-well pad. These programmable controllers can be linked back to a central control facility whereby operations can be remotely monitored and controlled by operating personnel with field personnel being dispatched to wells on an exception basis.

The new artificial lifting system does not require pressure from the surface in the casing in order to enhance the fill of the horizontal section of the outer production tubing and/or the extraction support mechanism. The relative volumes and the cycle times of the various tubings can be adjusted such that the outer or inner production casing can be full and ready by the time the outer production tubing and the inner production tubing have been displaced. With the lifting system 200 in place, circulation is possible for any reason, whether to do with chemical, or clean up, or lift, where in most completions circulation is not possible in horizontal wells, or in any case affects only the vertical section.

Figure 11:
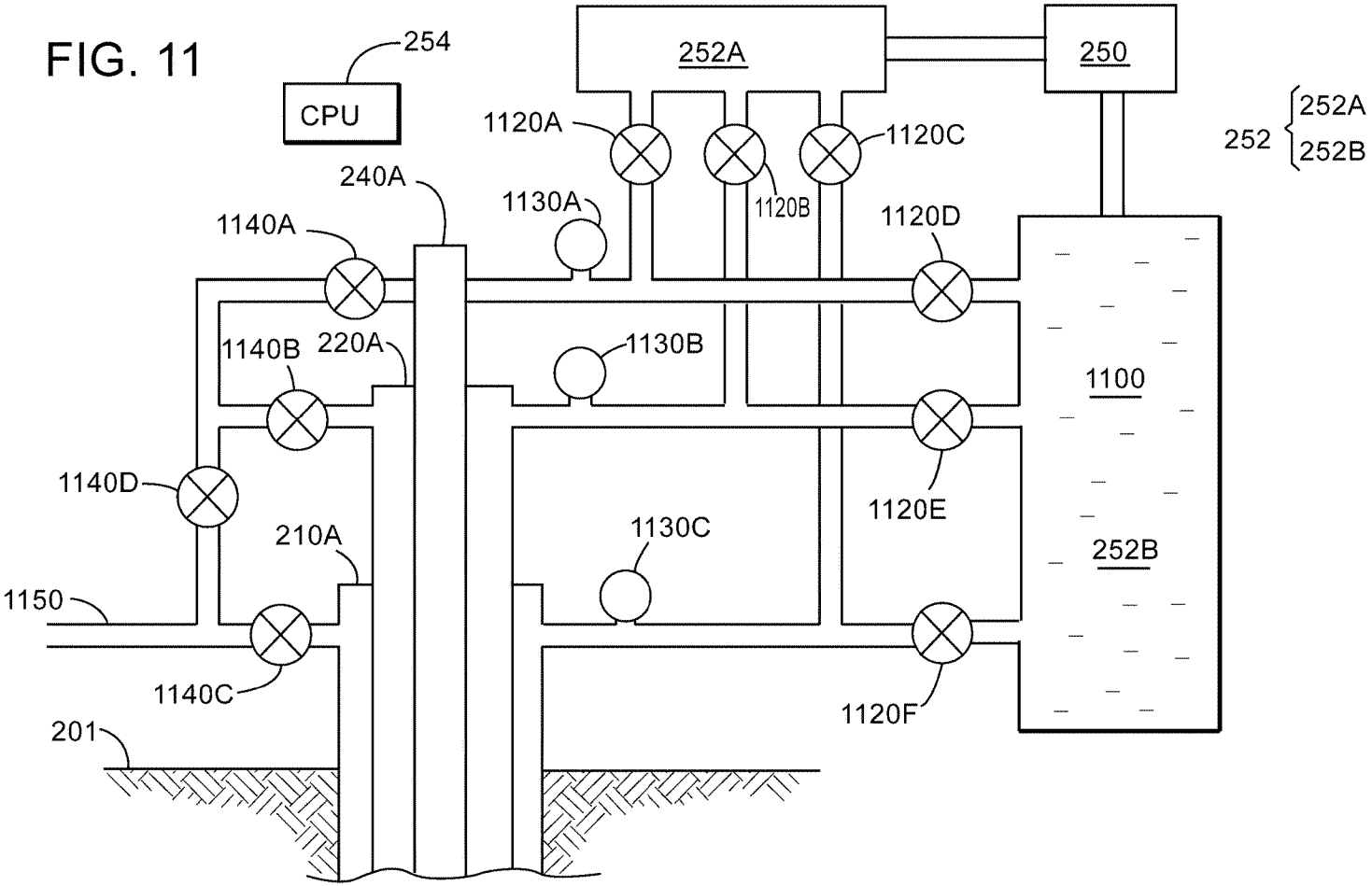
FIG. 11 illustrates a compressor and manifold system for lifting the oil from the horizontal well.

A possible connection manifold between the compressor and the head parts of the casing, outer production tubing, and the inner production tubing is now discussed with regard to FIG. 11. FIG. 11 shows the compressor 250 and its manifold 252, which has a suction manifold 252A and a discharge manifold 252B. The suction manifold 252A creates a low pressure sync, which sucks the formation fluid 214 into one or more of the outer production tubing and the inner production tubing, while the discharge manifold 252B creates a high pressure, that pushes a gas 1110 into the tubing. To control which tubing is connected to one of the two manifolds, a system of valves 1120A to 1120F are placed on the pipes that connect the manifolds to the head 210A of the casing, the head 220A of the outer production tubing, and the head 240A of the extraction support mechanism. Various pressure gauges 1130A to 1130C are also placed on these pipes for determining their internal pressures.

Controller 254, which may be a computing device that includes a processor, may communicate in a wired or wireless manner with each of the valves and the pressure gauges and may be programmed to close or open any of the valves. The formation fluid 214, when extracted on one of the casing, the outer production tubing and/or the inner production tubing, is directed through valves 1140A to 1140D to a sales line 1150, for being processed and/or stored. Note that in one embodiment, the formation fluid 214 extracted from the well is separated into gas and oil and the gas may be routed to the compressor to be pumped back into the well. While FIG. 11 shows one possible manifold connection between the compressor and the various tubing in the well, one skilled in the art would understand that other existing connections may be used.

Figure 12:
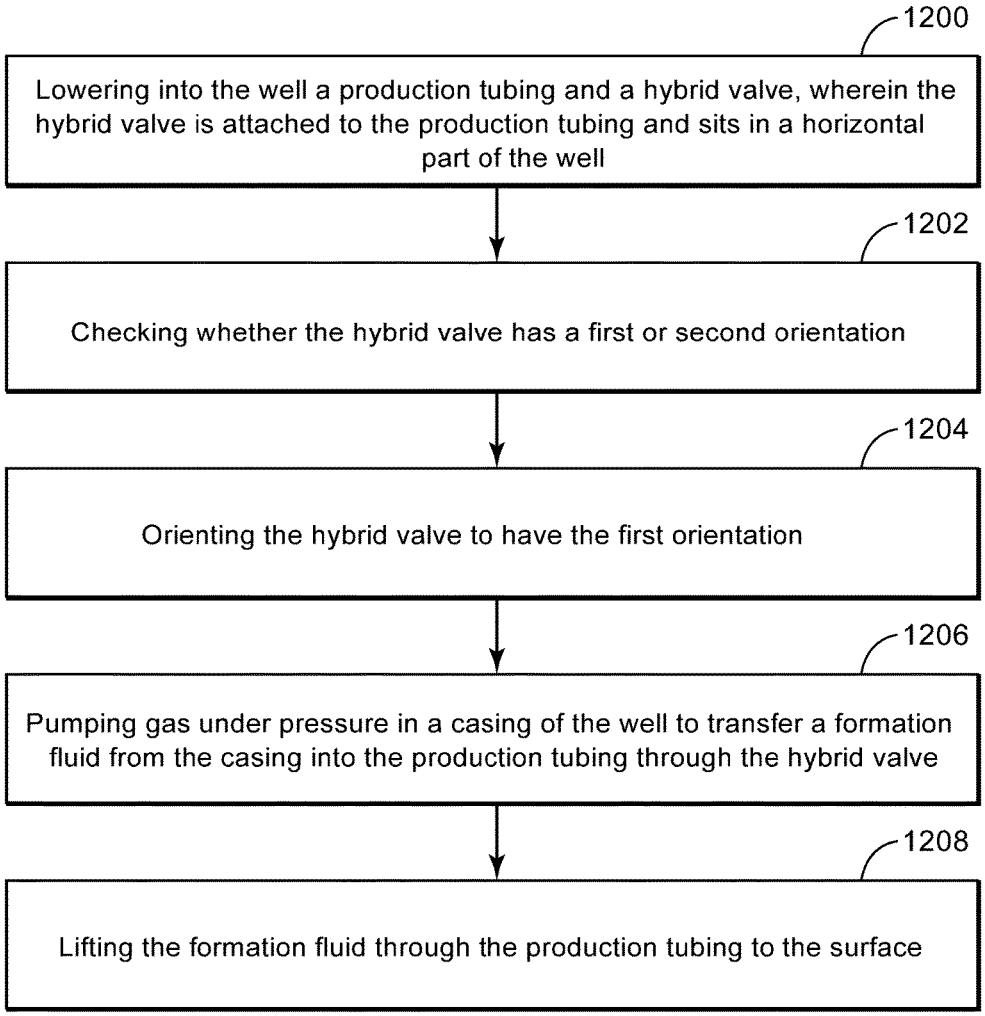
FIG. 12 is a flowchart of a method for lifting oil from a horizontal well with a hybrid valve.

A method for artificially lifting the formation fluid from the well to the surface is now discussed with regard to FIG. 12. The method includes a step 1200 of lowering into the well an outer production tubing and a hybrid valve, wherein the hybrid valve is attached to the outer production tubing and sits in a horizontal part of the well, a step 1202 of checking whether the hybrid valve has a first or second orientation, a step 1204 of orienting the hybrid valve to have the first orientation, a step 1206 of pumping gas under pressure in a casing of the well to transfer a formation fluid from the casing into the outer production tubing through the hybrid valve, and a step 1208 of lifting the formation fluid through the outer production tubing to the surface.

The method may also include rotating the outer production tubing to rotate the hybrid valve, or actuating a motor to rotate the hybrid valve relative to the outer production tubing. The step of lifting may include pumping a compressed gas through an extraction support mechanism, which is located within a bore of the outer production tubing, so that the formation fluid moves through an annulus formed by the interior of the outer production tubing and an exterior of the extraction support mechanism to the surface. Alternatively, the step of lifting may also include pumping a compressed gas through the outer production tubing, so that the formation fluid moves to the surface through a bore of an extraction support mechanism, which is located within a bore of the outer production tubing. The step of lifting may also include lowering a pump within a bore of the outer production tubing and pumping the formation fluid to the surface.

Note that the method discussed above may be applied to an existing well, as the hybrid valve and the inner production tubing may be installed inside an existing outer production tubing in various ways. For example, the outer production tubing may be have receptacle that is configured to engage the hybrid valve if the valve is pumped down along the outer tubing. After the hybrid valve have been attached to the outer production tubing, as discussed above or by other methods, the inner production tubing is lowered inside the outer production tubing. These operation can be performed at any point during the well life to convert it from simply tubing to valved lift tubing.

Figure 13:
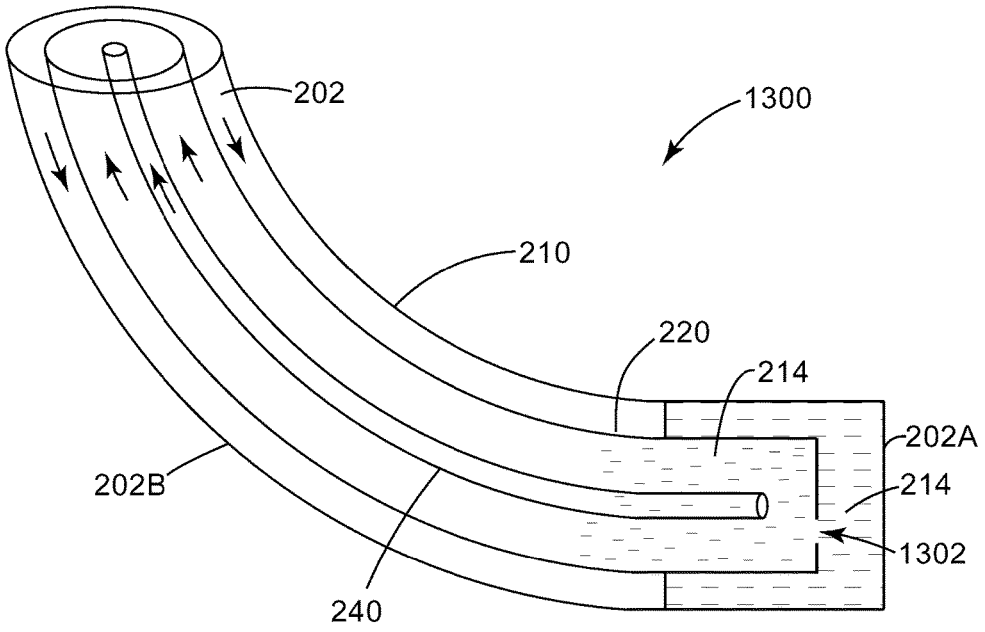
FIGS. 13 to 16 illustrate various stages of artificially lifting the oil from a horizontal well by not using any valve.

The embodiments discussed above have discussed the artificial lift method by using a hybrid valve attached to the outer production tubing. However, as now discussed, it is possible to implement this method without the hybrid valve. In this regard, FIG. 13 shows an embodiment in which the lift system 200 of FIG. 2, minus the hybrid valve 230, called now lift system 1300, is placed inside the well 202. An opening 1302 is formed in the bottom of the outer production casing 220 instead of the hybrid valve 230. It is noted that in this embodiment, that the horizontal well 202 has a toe 202A and a heel 202B. The toe 202A is defined as the most distal portion of the well from the well head and the heel 202B is defined as the point(s) where the well changes from a vertical direction to a horizontal direction. A downstream direction in this case is defined as pointing from the heel to the toe and an upstream direction is defined as pointing from the toe to the heel. With this system in place, the heads of the outer production tubing 220, the extraction support mechanism 240, and the casing 210 may be connected to the manifold shown in FIG. 11. The most distal point of the outer production tubing 220 is placed at the toe 202A of the well. The most distal point of the extraction support mechanism 240 may be placed, inside the outer production tubing 220, and at the toe 202A. This means that the low pressure sink of the well is placed near the toe of the horizontal well so that all the clusters along the lateral length of the well see a lowering of the flowing bottom hole pressure and improving ability for all clusters to contribute to production.

Figure 14:
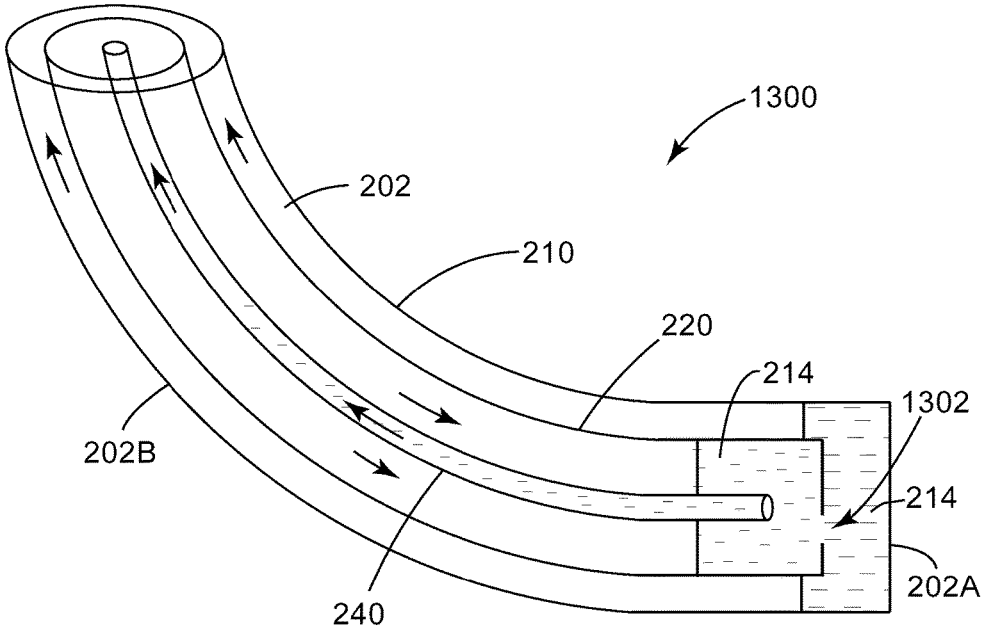

In the embodiment of FIG. 13, similar to the embodiment of FIG. 7, a gas may be pumped from the surface into the annulus between the casing 210 and the outer production tubing 220 so that the formation fluid 214 is pushed into the outer production tubing 220 and the extraction support mechanism 240 to the surface. FIG. 14, similar to FIG. 8, but for the hybrid valve 230, shows the outer production tubing 220 being also placed all the way to the toe of the well and gas being pumped from the surface in the annulus formed between the outer production tubing 220 and the extraction support mechanism 240. The formation fluid 214 is pushed upward to the surface along the inner of the extraction support mechanism 240 and in the annulus between the casing 210 and the outer production tubing 220.

Figure 15:
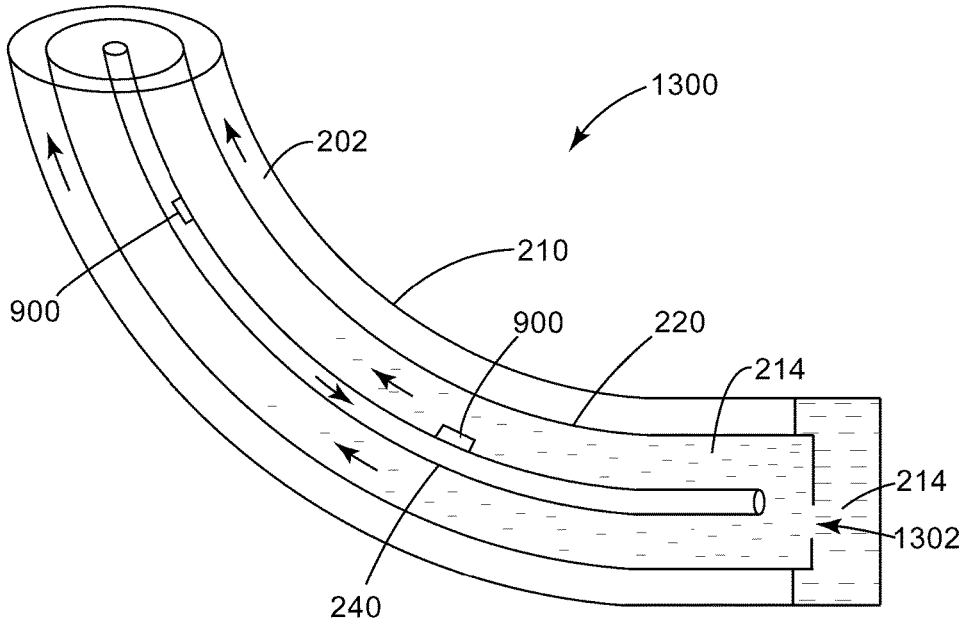

FIG. 15 shows another embodiment, similar to that of FIG. 9, but without the hybrid valve 230, in which the outer production tubing 220 is placed at the toe of the well and the gas is pumped down the extraction support mechanism 240 so that the oil is lifted to the surface through the annulus formed between the casing 210 and the outer production tubing 220 and the annulus formed between the outer production tubing 220 and the extraction support mechanism 240. For this case, but also for any other prior case, a flow conditioner 900 may be attached to either annulus. In one embodiment, if the formation pressure is high enough, it is possible to use only the flow conditioner 900 to lift the formation fluid 214 to the surface (i.e., no gas is pumped from the surface).

Figure 16:
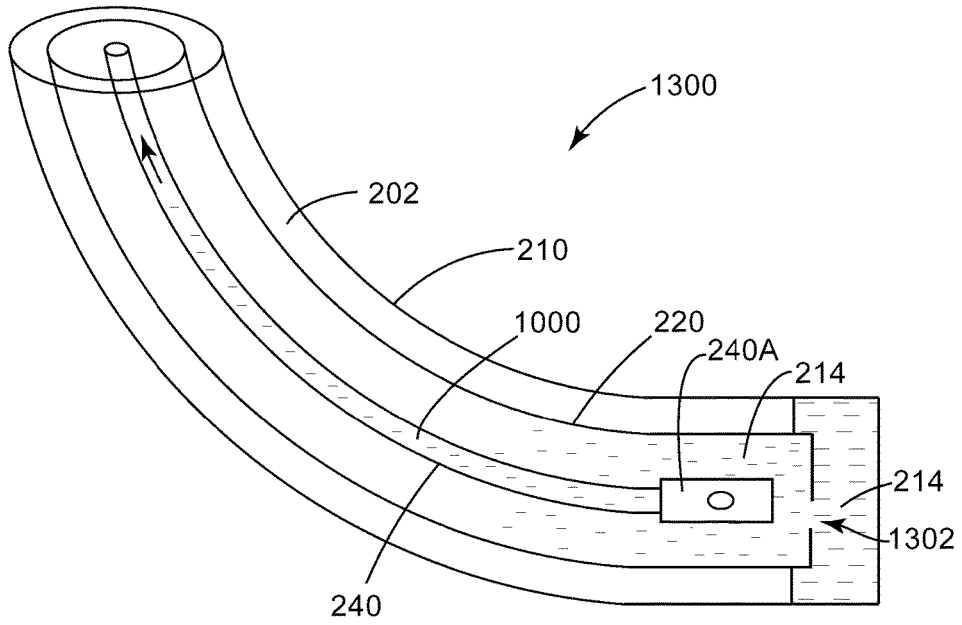

FIG. 16 shows another embodiment, that is similar to that of FIG. 10, except for the lack of the hybrid valve, in which the extraction support mechanism 240 is implemented as a pump-based device. Any pump known in the art may be used for lifting the formation fluid 214. Note that again the outer production tubing 220 is placed at the toe of the well.

With the embodiments discussed above, it is possible to apply chemical treatments throughout the entire wellbore on all exposed surfaces for the casing, outer production tubing, and the extraction support mechanism, by either batch or continuous treating methods for corrosion, scale or paraffin/asphaltene inhibition. As an example, a batch treatment could be pumped down the casing and recovered through the outer production tubing and the extraction support mechanism. Continuous treatments could be pumped with the gas lift down the outer production tubing and recovered up through the extraction support mechanism. Other combinations are possible as well, for example, pumping the gas down the extraction support mechanism or in the annulus between the casing and the outer production tubing. The treatment system can be incorporated into the surface components of the system 1300. In this case, circulation is possible between any of the annulus volumes in order to clean or stimulate the well, with or without chemicals.

Figure 17:
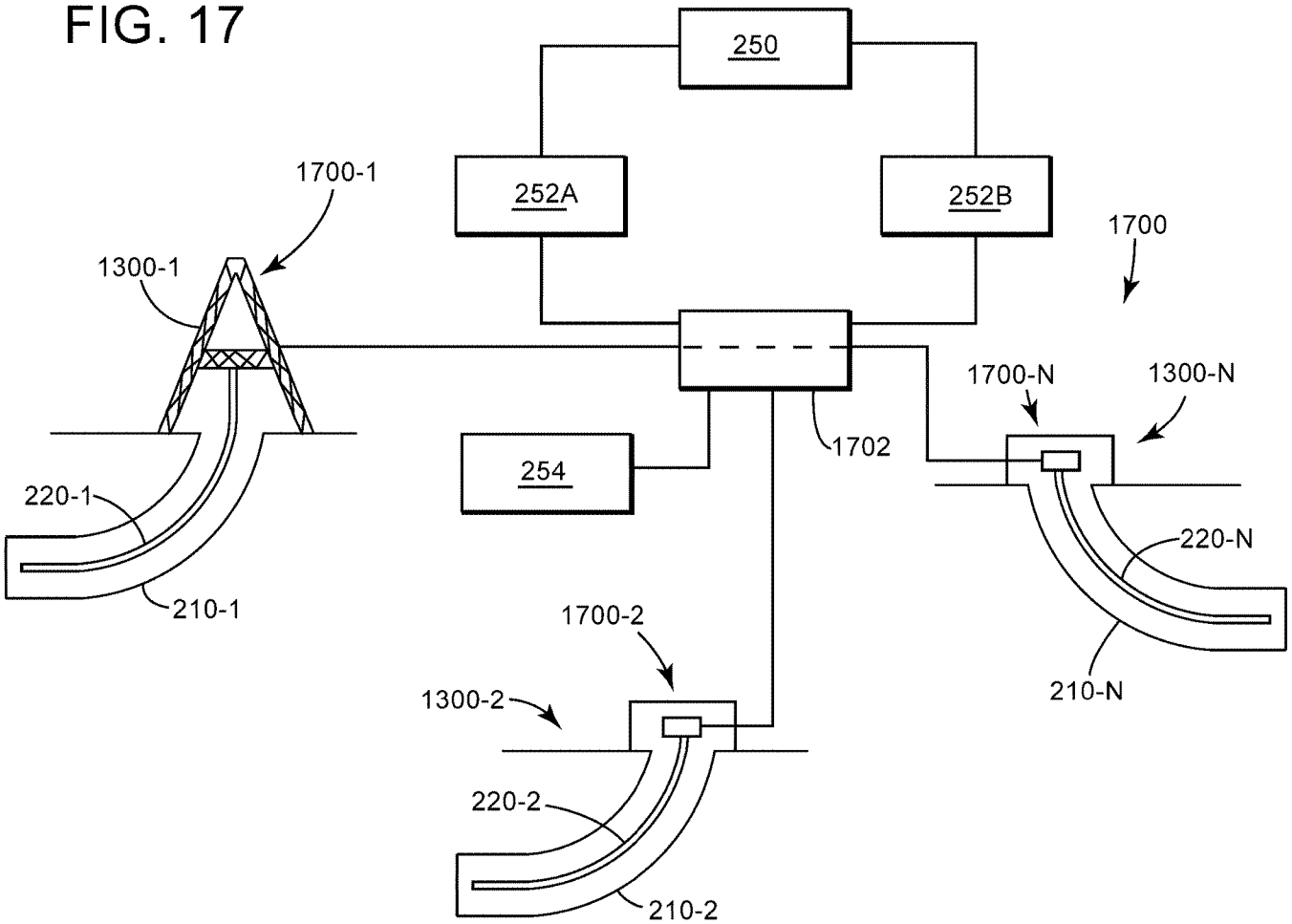
FIG. 17 illustrates a system of plural wells that uses the high pressure from one well to lift the formation fluid from another well.

In the previous embodiments, it has been discussed that sometimes a gas may be pumped down into the well, along one of the casing, the outer production tubing, and/or the extraction support mechanism. While the previous embodiments implied that a compressor is used for achieving this functionality, these embodiments should not be limited to such a source for the compressed gas. For example, as illustrated in FIG. 17, it is possible to have one system 1700 that includes plural wells 1700-1 to 1700-N, and each well has a corresponding artificial lift systems 1300-1 to 1300-N, where N can be any positive integer. Some or all of these systems may be connected to a valve bypass system 1702, that is under the direct control of a processor 254. For certain situations, the processor 254 bypasses the compressor 250 and its manifolds 252A and 252B for directly connecting, for example, artificial lift system 1300-N to 1300-1. For example, it is possible that the well 1700-1 associated with the artificial lift system 1300-1 is much older than the well 1700-N associated with the artificial lift system 1300-N. Thus, the formation pressure in well 1700-1 while the formation pressure in well 1700-N could be quite high. In this situation, it is possible, based on the readings of the pressure in these wells, to program the processor 254 to use the high pressure from the well 1700-N to act for pumping the gas inside the well 1700-1 for lifting the formation fluid. The processor 254 uses the valve bypass system 1702 to bypass the compressor 250. Those skilled in the art could use other sources of high pressure gas to provide it to well 1700-1 instead of a compressor. With this configuration, circulation is possible for any reason.

Figure 18:
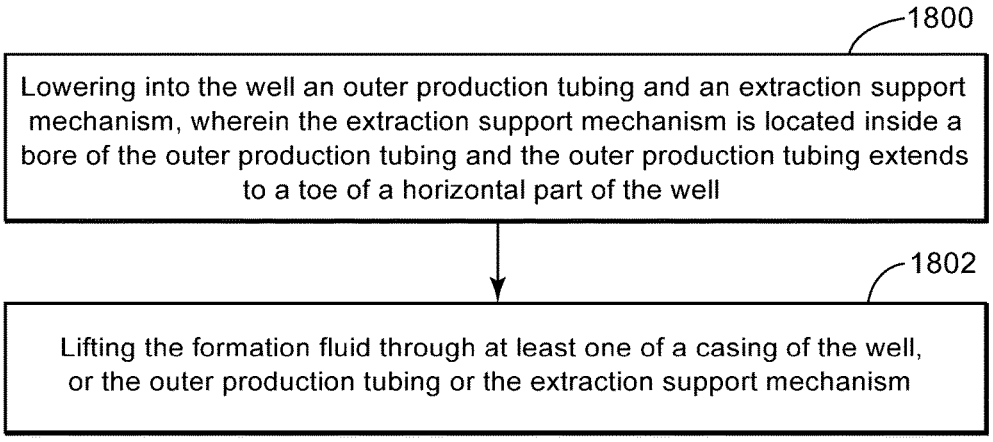
FIG. 18 is a flowchart of a method for lifting oil from a horizontal well without a valve.

Thus, according to a method illustrated in FIG. 18, it is possible in step 1800 to lower into the well an outer production tubing (220) and an extraction support mechanism (240), wherein the extraction support mechanism (240) is located inside a bore of the outer production tubing and the outer production tubing extends to a toe (202A) of a horizontal part of the well (202); and in step 1802 to lift the formation fluid (214) through at least one of a casing (210) of the well (202), or the outer production tubing (220) or the extraction support mechanism (240).

In one embodiment, the step of lifting includes pumping a compressed gas through the extraction support mechanism, which is located within a bore of the outer production tubing, so that the formation fluid moves through an annulus formed by the interior of the outer production tubing and an exterior of the extraction support mechanism to the surface. In another embodiment, step of lifting includes pumping a compressed gas through the outer production tubing, so that the formation fluid moves to the surface through a bore of an extraction support mechanism, which is located within a bore of the outer production tubing. In yet another embodiment, the step of lifting includes lowering a pump within a bore of the outer production tubing and pumping the formation fluid to the surface. In still another embodiment, the step of lifting includes connecting another well having a higher pressure, directly to the outer production tubing or the extraction support mechanism to lift the formation fluid. In still yet another embodiment, the step of lifting includes actuating one or more flow conditioners placed inside the outer production tubing, for lifting the formation fluid. In another application, the method includes applying a chemical treatment to one or more of a casing of the well, the outer production tubing, and to the extraction support mechanism.

The disclosed embodiments provide methods and systems for artificially lifting a formation fluid from a well when the natural pressure of the formation fluid is not enough to bring the formation fluid to the surface. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An artificial lifting system for bringing a formation fluid from a horizontal well to the surface, the system comprising:

an outer production tubing that extends into the well, from a head of the well to a lateral portion of the well;

a hybrid valve attached to a distal end of the outer production tubing; and an extraction support mechanism extending in a bore of the outer production tubing, wherein the hybrid valve has two orientations, a first orientation for which the hybrid valve acts as a one-way valve, and a second orientation for which the hybrid valve acts as a conduit, and wherein the extraction support mechanism is an inner production tube that does not contact the hybrid valve.

2. The system of claim 1, further comprising:

a motor connected to the hybrid valve and configured to rotate the hybrid valve.

3. The system of claim 1, wherein the hybrid valve has a first chamber separated by an internal passage from a second chamber.

4. The system of claim 3, wherein the hybrid valve includes a ball, the ball being located in the first chamber.

5. The system of claim 4, wherein the hybrid valve has an intake port that fluidly communicates with an exterior of the hybrid valve.

6. The system of claim 5, wherein the intake port communicates with the first chamber.

7. The system of claim 6, wherein the ball has a diameter larger than a diameter of the internal passage and a diameter of the intake port so that the ball cannot escape the first chamber.

8. The system of claim 7, wherein when in the first orientation, the ball blocks the intake port.

9. The system of claim 7, wherein when in the second orientation, the intake port fluidly communicates with the internal passage through the first chamber.

10. The system of claim 5, wherein the intake port is curved.

11. The system of claim 5, wherein an exterior face of the intake port mates with an interior of the casing.

12. The system of claim 1, wherein the hybrid valve is attached to the outer production tubing with a connection mechanism that allows the hybrid valve to freely rotate relative to the outer production tubing.

13. The system of claim 12, wherein the hybrid valve has a body including a first part and a second part, the first part is heavier than the second part, and an intake port is located in the first part.

* * * * *